US005120430A

United States Patent [19]

Morgan

[11] Patent Number: 5,120,430

[45] Date of Patent: Jun. 9, 1992

[54] COAL SOLUBILIZATION

[75] Inventor: David L. Morgan, Transvaal, South Africa

[73] Assignee: National Energy Council, Pretoria, South Africa

[21] Appl. No.: 589,606

[22] Filed: Sep. 28, 1990

[30] Foreign Application Priority Data

Sep. 28, 1989 [ZA] South Africa ..... 89/7388
Aug. 7, 1990 [ZA] South Africa ..... 90/6211

[51] Int. Cl.[5] ..... C10G 1/00
[52] U.S. Cl. ..... 208/428; 208/431
[58] Field of Search ..... 208/428, 431

[56] References Cited

U.S. PATENT DOCUMENTS 3,642,607 2/1972 Seitzer ..... 208/431
4,247,384 1/1981 Chen et al. ..... 208/8 LE
4,259,168 3/1981 Liotta ..... 208/8 LE
4,259,172 3/1981 Liotta ..... 208/46
4,298,450 11/1981 Ross et al. ..... 208/428
4,353,792 10/1982 Schneider et al. ..... 208/254 H
4,410,422 10/1983 Brunelle ..... 208/262.5
4,626,342 12/1986 Garg et al. ..... 208/419
4,728,418 3/1988 Shabatai et al. ..... 208/413

FOREIGN PATENT DOCUMENTS 179587 10/1984 Japan ..... 208/435
207489 9/1986 Japan ..... 208/435
292217 6/1928 United Kingdom .

*Primary Examiner*—A. Lionel Clingman
*Assistant Examiner*—Mary C. DiNunzio
*Attorney, Agent, or Firm*—Cushman, Darby & Cushman

[57] ABSTRACT

A method of solubilizing organic material in a coal includes the steps of contacting the coal with a medium comprising an organic solvent and a strong base or phenoxide reactively associated with the solvent. The solvent may be an aprotic dipolar solvent such as N-methyl pyrrolidone. The strong base may be sodium or potassium hydroxide.

13 Claims, No Drawings

COAL SOLUBILIZATION

BACKGROUND OF THE INVENTION

This invention relates to coal solubilisation.

Coal solubilisation involves extracting organic material from the coal into a solvent and filtering the organic-rich solvent to remove the undissolved organic and mineral matter. Various coal solubilisation methods are known. One such method involves contacting the coal with hot, e.g. about 200° C., N-methyl pyrrolidone (NMP). This method achieves approximately 50% dissolution of the organic material and must be carried out at elevated temperature. Coal can also be solubilised in a mixture of NMP and carbon disulphide at room temperature. However, this dissolution medium is extremely odorous and unpleasant. Also, the products produced tend to be sticky and rather difficult to work with and contain an undesirable amount of sulphur.

SUMMARY OF THE INVENTION

According to the present invention, there is provided a method of solubilising organic material in a coal including the steps of contacting the coal with a medium comprising an organic solvent and a strong base or a phenoxide reactively associated with the solvent.

DESCRIPTION OF EMBODIMENTS

The strong base will preferably be one having a $pK_a$ value of its conjugate acid in the range 14 to 30. With such bases the organic solvent will not be adversely affected by the base which is reactively associated with it. The term "reactively associated" in the specification and claims means the base will dissolve or disperse to some extent in the organic solvent.

The base may be a metal hydroxide in which event hydroxide ions will be dissolved or dispersed in the organic solvent in such manner as to allow a substantial quantity of the organic material from the coal to be solubilised. The metal hydroxide will preferably be a strong hydroxide such as potassium hydroxide or sodium hydroxide and may be added in concentrated form. The hydroxide may also be produced in situ, as for example, by the addition of sodium sulphide which hydrolyses to sodium hydroxide.

Examples of other suitable bases are metal alcoholates such as sodium methoxylate, sodium ethoxylate or potassium t-butoxide, or a quaternary ammonium hydroxide such as tetraethyl ammonium hydroxide.

Examples of phenoxides are calcium, sodium and potassium phenoxide.

A suitable phase transfer catalyst may be included in the medium to ensure that an effective quantity of the base is transferred to the organic solvent. Examples of suitable phase transfer catalysts are various crown ethers such as 1, 4, 7, 10, 13, 16-hexa oxacyclooctadecane (18-crown-6). Other suitable phase transfer catalysts are:

Polyethylene glycol 400
Polyethylene glycol 4000
Tris[2-(2-methoxyethoxy)ethyl]amine (TDA-1)
Tetraethyl ammonium bromide
Tetrabutyl ammonium bromide
Tetrabutyl ammonium hydrosulphate
Cetyl trimethyl ammonium chloride Examples of suitable organic solvents where a phase transfer catalyst may be used are pyridine and dipolar aprotic solvents such as dimethylformamide, dimethylsulphoxide, dimethyltetrahydropyrimidinone, and dimethylimidazolidinone.

For many of the dipolar aprotic solvents, it has been found that no phase transfer catalyst need be used. Since phase transfer catalysts are expensive, this is the preferred medium for the practice of the invention.

The quantity of solvent which is present in the medium will be sufficient to ensure that a desired amount of organic material is extracted from the coal.

Mixtures of the solvents useful in the practice of the invention with other solvents may be used.

The solubilisation may take place at room or ambient temperature or at elevated temperature. Generally temperatures in excess of about 100° C. are not necessary or desirable as hydrolysis of the solvent can occur at elevated temperature.

The coal will preferably be a high ranking coal such as a bituminous or coking coal. These coals are characterised, for example, by having high carbon contents, e.g. 85 to 90% carbon on a dry ash free basis. The invention may be used on wet or dry coals. The coal may be provided in finely particulate form, e.g. having a particle size of less than 250 microns, or in the form of relatively large pieces.

Good contact between the coal and the medium should be maintained, e.g. with agitation. The contact should be for at least two hours and preferably longer periods, e.g. 10 to 24 hours.

The extracted material will report in the medium. This medium will be separated from the insoluble residue using any known method. The solvent may be separated from the extracted material using any known method to give a solid organic residue substantially free of inorganic coal mineral components. This residue or the organic phase containing the dissolved organic material may be used as a binder or a fuel, as a source of chemicals, or it may be converted into a higher form of carbon such as graphite.

The invention will be illustrated by the following examples. In these examples, the degree of extraction was measured in terms of the degree of carbon extracted by the following formula:

$$\% \text{ C extraction} = \frac{(\text{weight carbon in untreated coal} - \text{weight carbon in residue}) \times 100\%}{\text{weight carbon in untreated coal}}$$

EXAMPLE 1

High rank bituminous coal (7 g), organic solvent (70 ml) and potassium hydroxide (1.1 g) were gently agitated at room temperature for 24 hours. The residue was washed with an equal volume of solvent, then with water, dried under vacuo and weighed. Its carbon content was determined and the degree of carbon extraction calculated. A number of solvents were tried both with and without the phase transfer catalyst, 18-crown-6. When used, the amount of catalyst in the medium was 2.5 g. The results are set out in the following table:

| | % CARBON EXTRACTION | | |
|---|---|---|---|
| SOLVENT | NO ADDITIVE | KOH | KOH + 18-Cr-6 |
| N-methylpyrrolidone | 6 | 80 | 80 |
| Dimethylformamide | trace | 83 | 79 |

-continued

| SOLVENT | % CARBON EXTRACTION NO ADDITIVE | KOH | KOH + 18-Cr-6 |
|---|---|---|---|
| Dimethylsulphoxide | trace | 62 | 73 |
| Dimethylacetamide | trace | 79 | 80 |
| Dimethyldigol | trace | trace | trace |
| Morpholine | trace | trace | 5 |
| Peperidine | trace | trace | trace |
| Tetrahydrofuran | trace | trace | trace |
| Ethanol | trace | trace | trace |
| Formamide | trace | trace | trace |
| Dimethylimidazolidinone | trace | 83 | N/A |
| Dimethyltetrahydropyrimidinone | trace | 64 | N/A |
| Tetramethylurea | trace | 57 | N/A |
| Diethyleneglycoldimethylether | trace | trace | trace |
| Tetraethyleneglycoldimethylether | trace | trace | trace |
| Hexamethylphosphorictriamide | trace | 8 | 7 |

Trace in this Table means less than 5%.

It is apparent from the above that the potassium hydroxide was not reactively associated with a number of organic solvents, notably dimethyldigol, morpholine, piperidine, tetrahydrofuran, ethanol, formamide, diethyleneglycoldimethylether, tetraethyleneglycoldimethylether and hexamethylphosphorictriamide.

EXAMPLE 2

High rank bituminous coal (4 g) was gently stirred at room temperature with a mixture of pyridine (60 ml), potassium hydroxide (0.22 g) and 18-crown-6 (0.5 g) for 24 hours and then centrifuged. The supernatant extract was decanted and the residue re-extracted four times with the mixture of pyridine, potassium hydroxide and 18-crown-6. The residue was then filtered, washed well with water and dried and weighed. The carbon content of the residue was determined and the degree of extraction of the coal was found to be 85%. A similar extraction using pyridine only was 7%.

EXAMPLE 3

A high-ranked bituminous coal was extracted five times, at room temperature with a mixture of pyridine and potassium t-butoxide in the ratios of 17.5 ml pyridine to 0.5 g potassium t-butoxide to 1 g coal. The percentage carbon extracted was found to be 76%.

EXAMPLE 4

The high-ranked bituminous coal was extracted as in Example 1 with a mixture of pyridine and a solution of tetraethyl ammonium hydroxide (TEAH) in water in the ratio of 17.5 ml pyridine to 2.5 ml of 50% TEAH in water, to 1 g coal. The percentage carbon extracted was found to be 51%.

EXAMPLE 5

High-ranking bituminous coal was extracted at room temperature with a mixture of N-methyl pyrrolidone (NMP) and sodium methoxylate for 24 hours. The components were in the rates of 10 ml NMP to 0.157 g sodium methylate to 1 g coal. The degree of carbon extraction found was 72%.

EXAMPLE 6

Effect of Sodium Hydroxide

Using the procedure set out in Example 1 with sodium hydroxide (0.8 g) as solid or as 50% aqueous solution, in place of the potassium hydroxide, the following carbon extractions were obtained:

| SOLVENT | % CARBON EXTRACTION NaOH (solid) | NaOH (50% solution) | NaOH + 18-crown-6 |
|---|---|---|---|
| N-methylpyrrolidone | 71 | 80 | 82 |
| Dimethylformamide | 77 | 80 | 77 |

EXAMPLE 7

Effect of Water

Using the procedure set out in Example 1, various quantities of water were added to the NMP solvent. The results are set out below:

| | % CARBON EXTRACTION |
|---|---|
| NMP (dried) | 80 |
| NMP + 3% water | 79 |
| NMP + 6% water | 76 |

The effect of water is obviously not very important.

EXAMPLE 8

Effect of Coal Conversion

The procedure set out in Example 1 was varied by changing the coal:solvent ratio, keeping the coal:KOH ratio constant. The results for NMP and dimethylformamide (DMF) as solvents are given hereinafter:

| SOLVENT | g Coal/100 ml Solvent | % CARBON EXTRACTION |
|---|---|---|
| DMF | 7,1 | 78 |
| | 16.7 | 70 |
| | 27,3 | 53 |
| | 40,0 | 47 |
| NMP | 27,3 | 79 |
| | 40,0 | 80 |

I claim:

1. A method of solubilising organic material in a coal includes the steps of contacting the coal with a medium comprising a dipolar, aprotic organic solvent and a strong base or a phenoxide reactively associated with the organic solvent.

2. A method according to claim 1 wherein the medium further contains a phase transfer catalyst.

3. A method according to claim 2 wherein the phase transfer catalyst is a crown ether.

4. A method according to claim 1 wherein the dipolar aprotic solvent is selected from dimethylformamide, dimethylsulphoxide, dimethylacetamide, N-methylpyrrolidone, tetramethylurea, dimethyltetrahydropyrimidimone, and dimethylimidazoldinone.

5. A method according to claim 1 wherein the base has a $pK_a$ value of its conjugate acid in the range 14 to 30.

6. A method according to claim 1 wherein the base is a metal hydroxide.

7. A method according to claim 6 wherein the metal hydroxide is selected from sodium and potassium hydroxide.

8. A method according to claim 1 wherein the base is selected from a metal alcoholate and a quaternary ammonium hydroxide.

9. A method according to claim 1 wherein the phenoxide is selected from calcium, sodium and potassium phenoxides.

10. A method according to claim 1 wherein contact of the coal with the medium takes place at a temperature not exceeding about 100° C.

11. A method according to claim 1 wherein the coal is a high ranking coal.

12. A method according to claim 11 wherein the high ranking coal is selected from bituminous and coking coals.

13. A method according to claim 1 wherein contact between the coal and the medium is maintained for a period of at least two hours.

* * * * *